United States Patent [19]

Campbell

[11] 4,080,881

[45] Mar. 28, 1978

[54] BUILDING CONSTRUCTION

[75] Inventor: Henry Fred Campbell, Belleville, Mich.

[73] Assignee: Campbell Research Corporation, Detroit, Mich.

[21] Appl. No.: 735,266

[22] Filed: Oct. 26, 1976

Related U.S. Application Data

[63] Continuation-in-part of Ser. No. 580,065, May 22, 1975, Pat. No. 3,987,714, which is a continuation of Ser. No. 452,751, Mar. 20, 1974, abandoned.

[51] Int. Cl.[2] ..... F24F 7/04

[52] U.S. Cl. ..... 98/31; 98/40 D; 52/221; 52/263

[58] Field of Search ..... 98/40 D, 40 R, 40 C, 98/33 A, 31; 52/303, 220, 263, 173, 221

[56] References Cited

U.S. PATENT DOCUMENTS

| | | | |
|---|---|---|---|
| 2,221,001 | 11/1940 | Lucius | 98/40 D |
| 2,569,910 | 10/1951 | Venuti | 52/221 |
| 2,596,300 | 5/1952 | Smith | 236/49 |
| 2,616,529 | 11/1952 | MacDonald | 98/31 |
| 2,858,077 | 10/1958 | Smith | 98/40 C |
| 2,988,980 | 6/1961 | Tschudin | 98/40 D |
| 3,227,062 | 1/1966 | Andersson | 98/31 |
| 3,367,257 | 2/1968 | Raider et al. | 98/40 D |
| 3,368,473 | 2/1968 | Sohda et al. | 98/31 |
| 3,488,905 | 1/1970 | Campbell | 52/263 |
| 3,893,276 | 7/1975 | Brown | 98/40 D |

*Primary Examiner*—William F. O'Dea
*Assistant Examiner*—Henry C. Yuen
*Attorney, Agent, or Firm*—Barnes, Kisselle, Raisch & Choate

[57] ABSTRACT

A building construction comprising a plurality of spaced parallel structural beams supported on columns. Trusses extend between the beams and layers of roofing material are applied over the beams and the trusses to define a duct at each beam through which air can pass and in which utilities and other service lines are located.

2 Claims, 7 Drawing Figures

BUILDING CONSTRUCTION

This application is a continuation-in-part of U.S. application Ser. No. 580,065, filed May 22, 1975, now U.S. Pat. No. 3,987,714, which was a continuation of application Ser. No. 452,751, filed Mar. 20, 1974, now abandoned.

This invention relates to buildings and particularly to commercial buildings.

BACKGROUND OF THE INVENTION

In designing and erecting buildings, it is conventional to utilize spaced beams over which decking is applied and thereafter roofing is applied to provide the roof of the building. In such buildings, the heating and ventilating is usually added to the interior of the building.

Among the objects of the invention are to provide a building construction wherein substantial loads can be supported with minimum use of columns and wherein the heating and ventilating system can be incorporated in the roof structure without projecting into the interior of the building.

SUMMARY OF THE INVENTION

In accordance with the invention, a plurality of spaced parallel structural beams or trusses are provided and a plurality of trusses or joists extending between adjacent transverse beams. Roofing means are associated with at least one of the beams and trusses and define a duct at each beam for the passage of air and in which utilities or service lines can be located.

DESCRIPTION

Figure 1:
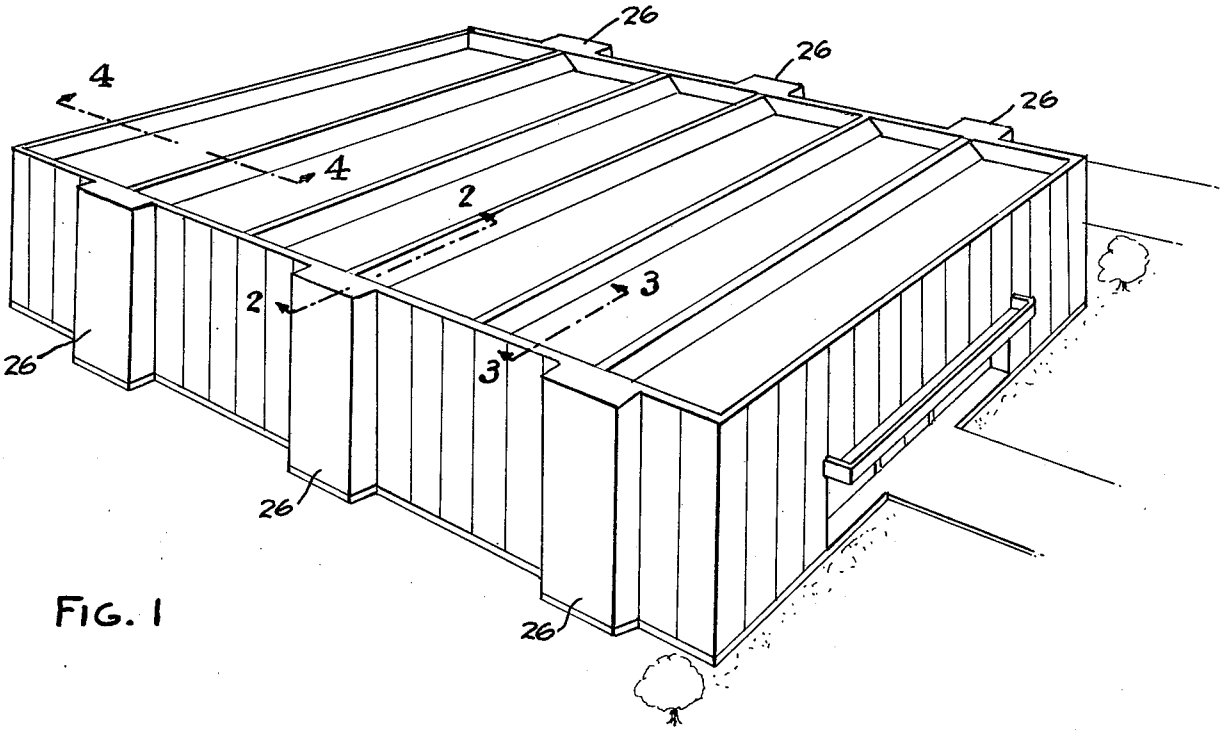
FIG. 1 is a perspective view of a building embodying the invention.

Referring to FIG. 1, the building embodying the invention is particularly adapted for commercial use wherein high ceilings are desired and open spaces are preferred and comprises a combined roof and ceiling structure 10 supported by vertical load-bearing columns or walls 11.

Figure 3:
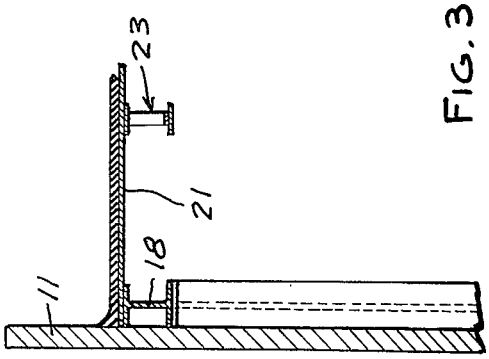
FIG. 3 is a fragmentary sectional view on an enlarged scale taken along the line 3—3 in FIG. 1.
Figure 3A:
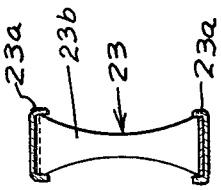
FIG. 3*a* is a cross section of a truss member used in the building.
Figure 2:
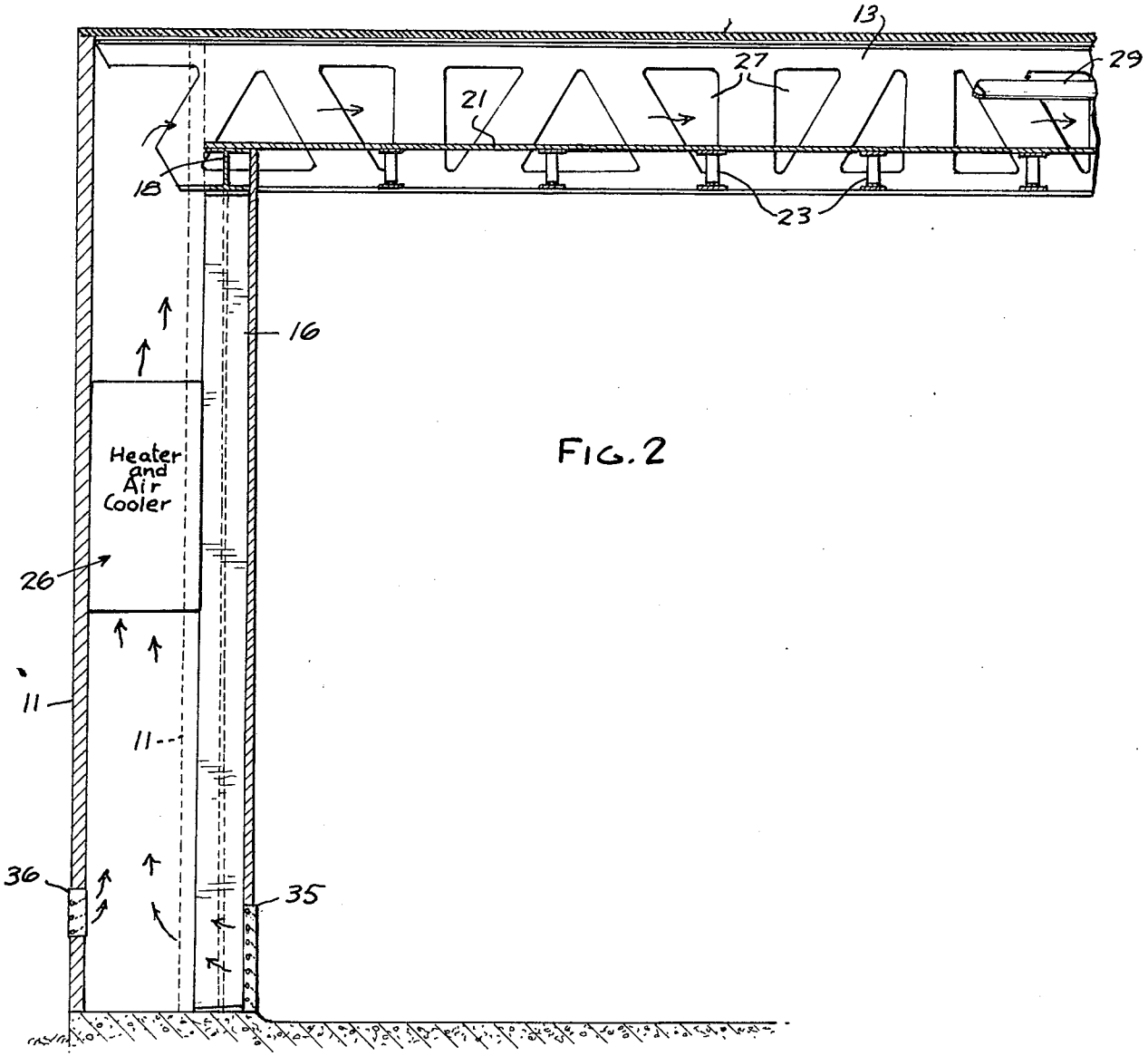
FIG. 2 is a fragmentary sectional view on an enlarged scale taken along the line 2—2 in FIG. 1.
Figure 4:
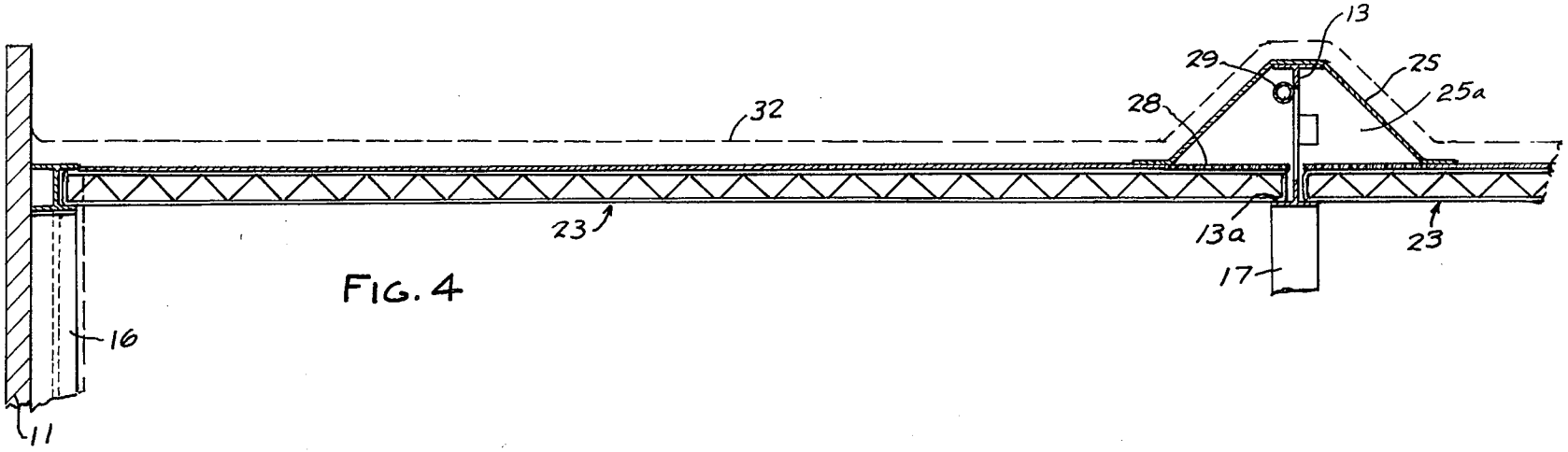
FIG. 4 is a fragmentary sectional view on an enlarged scale taken along the line 4—4 in FIG. 1.
Figure 6:
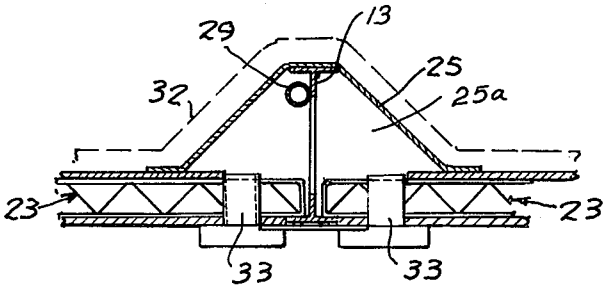
FIG. 6 is a fragmentary sectional view of a further modified form of the invention.

Referring to FIGS. 2–4, the roof structure includes a plurality of vertical load-bearing columns 16, 17 and a plurality of transversely extending parallel structural load-bearing beams or trusses 13 supported by said columns 16 along the periphery and by columns 17 at points within the periphery. Load-bearing cross beams 18 are provided between the ends of transverse beams 13. A plurality of prefabricated load-bearing truss members or joists 23 extend in parallel relationship between the lower webs of flanges 13*a* of adjacent transverse beams 13. Each truss member 23 preferably comprises sheet metal channels 23*a*, between which an undulating strut 23*b* extends. Rigid load-bearing sheets 21 are laid or poured in place over the truss members 23.

A duct is provided along each transverse beam 13 and is formed by a sheet metal cap 25 defining a duct 25*a*. Heating and ventilating air from units 26 preferably provided at the ends of the building is directed through each end of duct 25*a*. In order to produce a uniform plenum effect, the beam 13 is preferably provided with spaced openings 27 to permit free passage of air from one side to the other of the beam. Portions of the top sheet 21 are perforated at the duct as at 28 so that air may freely pass from the duct downwardly through the perforations 28 into the interior of the building thereby heating or cooling the building.

In addition, other utilities may be provided in the duct such as a sprinkler supply pipe 29 extending longitudinally of the duct. The duct not only provides a space for the sprinkler pipe 29 but additionally functions to maintain the pipe sufficiently warm to prevent freezing of any water in the sprinkler pipe. Additional service lines or pipes can be conveniently provided in the duct.

Roofing material 32 is provided over the sheets 21 and the duct cap 25 and preferably comprises a plurality of coatings such as polyurethane and silicone.

It can thus be seen that beams 13 and truss members 23 comprise the structural roof as well as the heating and air conditioning ducts. As a result, it is not necessary to suspend ducts below the roof and the interior volume of the building is not reduced.

Figure 5:
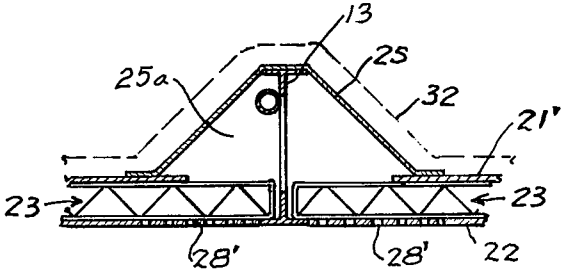
FIG. 5 is a fragmentary vertical sectional view through a modified form of the invention.

In the modified form of the invention shown in FIG. 5, additional sheets 22 are laid between the webs 13*a* of beams 13 and truss members 23 are laid over the sheets. In this instance, the top sheet 21' can be made shorter and perforations 28' are provided in sheet 22 beneath the duct.

In the form of the invention shown in FIG. 4, air from the duct is distributed through registers 33.

In each form, the units 26 include a heating and air conditioning unit 34 which draws air from a register 35 to condition the air before passage to the duct. A cold air make up duct 36 can be provided for bringing in fresh air.

I claim:

1. In a building construction, the combination comprising a plurality of vertical load-bearing columns, a plurality of spaced parallel structural load-bearing I beams, each said beam having a pair of upper webs and a pair of lower webs extending horizontally and being directly supported by said columns, and at least two sets of load-bearing truss members extending between and resting on and supported by the lower webs of said beams, each said truss member having a height less than the height of said structural beams, load-bearing ridgid sheets on the tops of said sets of truss members, and roofing material over at least one said beam and the associated sheets of said sets of truss members defining an air duct extending longitudinally above the plane defined by the tops of said trusses adjacent each said beam for passing air and locating utility and service lines.

2. The combination set forth in claim 1 including sheet material on the underside of said sets of truss members.

* * * * *